US010875610B1

(12) United States Patent
Hellweg

(10) Patent No.: US 10,875,610 B1
(45) **Date of Patent: *Dec. 29, 2020**

(54) SPORTS BOARD STORAGE DEVICE

(71) Applicant: Eriic Hellweg, Perris, CA (US)

(72) Inventor: Eriic Hellweg, Perris, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/833,627

(22) Filed: Mar. 29, 2020

Related U.S. Application Data

(63) Continuation of application No. 16/724,260, filed on Dec. 21, 2019.

(51) Int. Cl.
*B63B 32/83* (2020.01)
*B63B 32/40* (2020.01)

(52) U.S. Cl.
CPC ..... *B63B 32/83* (2020.02); *B63B 32/40* (2020.02)

(58) Field of Classification Search
CPC ..... B63B 32/83; B63B 32/80; B63B 32/70; B60R 9/08; B60R 9/12; B60R 9/048; B25B 5/14; A47F 7/0035; A47F 5/2013; A47B 47/005; A47B 7/0058; A63C 11/028
USPC ..... 224/406
See application file for complete search history.

(56) References Cited

U.S. PATENT DOCUMENTS 3,018,897 A * 1/1962 Carlyle ..... A63C 11/02 211/70.5
3,209,970 A * 10/1965 Canell ..... B60R 9/12 224/319
5,096,102 A * 3/1992 Tolson ..... B60R 9/06 224/501
2005/0155999 A1* 7/2005 Gasper ..... B60R 9/08 224/406

* cited by examiner

*Primary Examiner* — Adam J Waggenspack

(57) ABSTRACT

A storage device is configured to hold one or more sports boards. The storage device has a mechanism that transitions the device between a clamped and unclamped state upon actuation of a an actuation device. A user can actuate an actuator from a first position towards the device to a second position to transition the device from the clamped to the unclamped state.

10 Claims, 16 Drawing Sheets

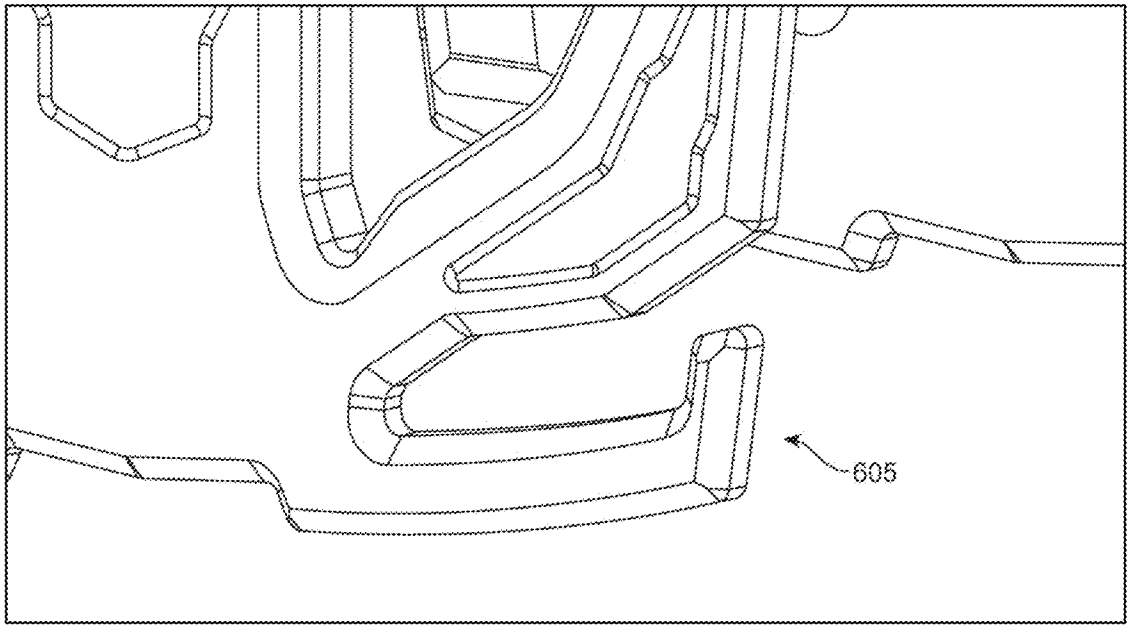
FIG. 6
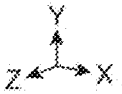

SPORTS BOARD STORAGE DEVICE

REFERENCE TO PRIORITY DOCUMENT

This application is a continuation of U.S. patent application Ser. No. 16/724,260 entitled "SPORTS BOARD STORAGE DEVICE" and filed on Dec. 21, 1019, which claims priority to co-pending U.S. Provisional Patent Application Ser. No. 62/788,328 entitled "Sports Board Storage Device" and filed on Jan. 4, 2019. The disclosures of the patent applications are incorporated herein by reference in their entirety.

BACKGROUND

Wakeboarding is a sport that is growing in popularity. In the sport of wakeboarding, a boat tows a person by a rope in a similar manner similar waterskiing. However, a typical wakeboard is wider and shorter than a waterski. Consequently, a wakeboard may use up a different quantity of space in a boat relative to the space used by a waterski. In view of this, with wakeboards there is a need for proper storage of one or more wakeboards on a boat in a manner that does not inhibit space within the passenger compartment of a boat.

Consequently, wakeboards are often stored in an onboard board storage device that clamps one or more wakeboards in a fixed position on the boat. Current storage devices for boards such as wakeboards have certain drawbacks and there is a need for improved storage devices for wakeboards and other planar devices.

SUMMARY

Disclosed herein is a storage device that is configured to hold or store one or more planar devices, such as wakeboards.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

FIG. 6 shows an enlarged view of a hook of the board storage device.

DETAILED DESCRIPTION

Before the present subject matter is further described, it is to be understood that this subject matter described herein is not limited to particular embodiments described, as such may of course vary. It is also to be understood that the terminology used herein is for the purpose of describing a particular embodiment or embodiments only and is not intended to be limiting. Unless defined otherwise, all technical terms used herein have the same meaning as commonly understood by one skilled in the art to which this subject matter belongs.

Disclosed herein is a storage device that is configured to hold or store one or more planar devices, such as wakeboard(s). Although the device is described herein in the context of storing wakeboards, it should be appreciated that the device can be used to store any of a variety of devices and in particular planar devices such as wakeboards or other sports boards. The storage device has a clamp mechanism that can be actuated to exert a clamping force onto one or more wakeboards that are positioned on or in the storage device to retain the one or more wakeboards on the storage device, as described more fully below. The clamp mechanism can be locked into a clamped (or clamping) state such that the clamped wakeboard(s) cannot be removed from the board storage device when the clamp mechanism is locked.

In an embodiment, a user pushes or otherwise moves (such as downwardly) a clamp arm of the clamp mechanism from a first (or unclamped or released) position to a second (or clamped or clamping) position to transition the clamp mechanism from an unclamped state to a clamped state. An internal lock mechanism is configured to automatically place the boards in a clamped, compressed state within the board storage device when the clamp arm is pushed or otherwise moved toward the second position. A lock device, such as a padlock, can be coupled to the clamp arm to constrain or lock the clamp arm in the second position and thereby lock the clamped wakeboards in place within the board storage device.

The board storage device also includes one or more hooks that are configured to hang or store an item, such as a life jacket. In addition, the board storage device includes one or more flag holders.

Figure 1:
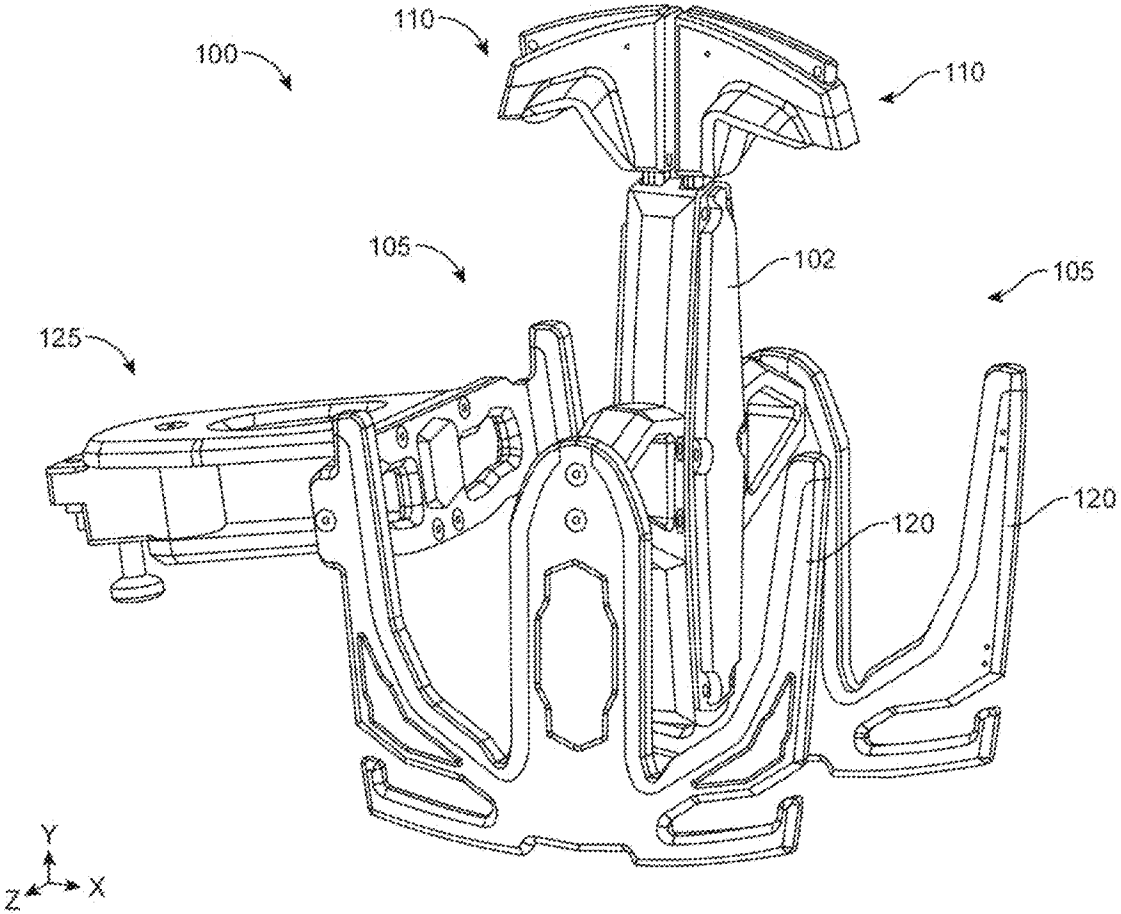
FIG. 1 shows a perspective view of a board storage device with a clamp arm in a closed or retracted position.
Figure 2:
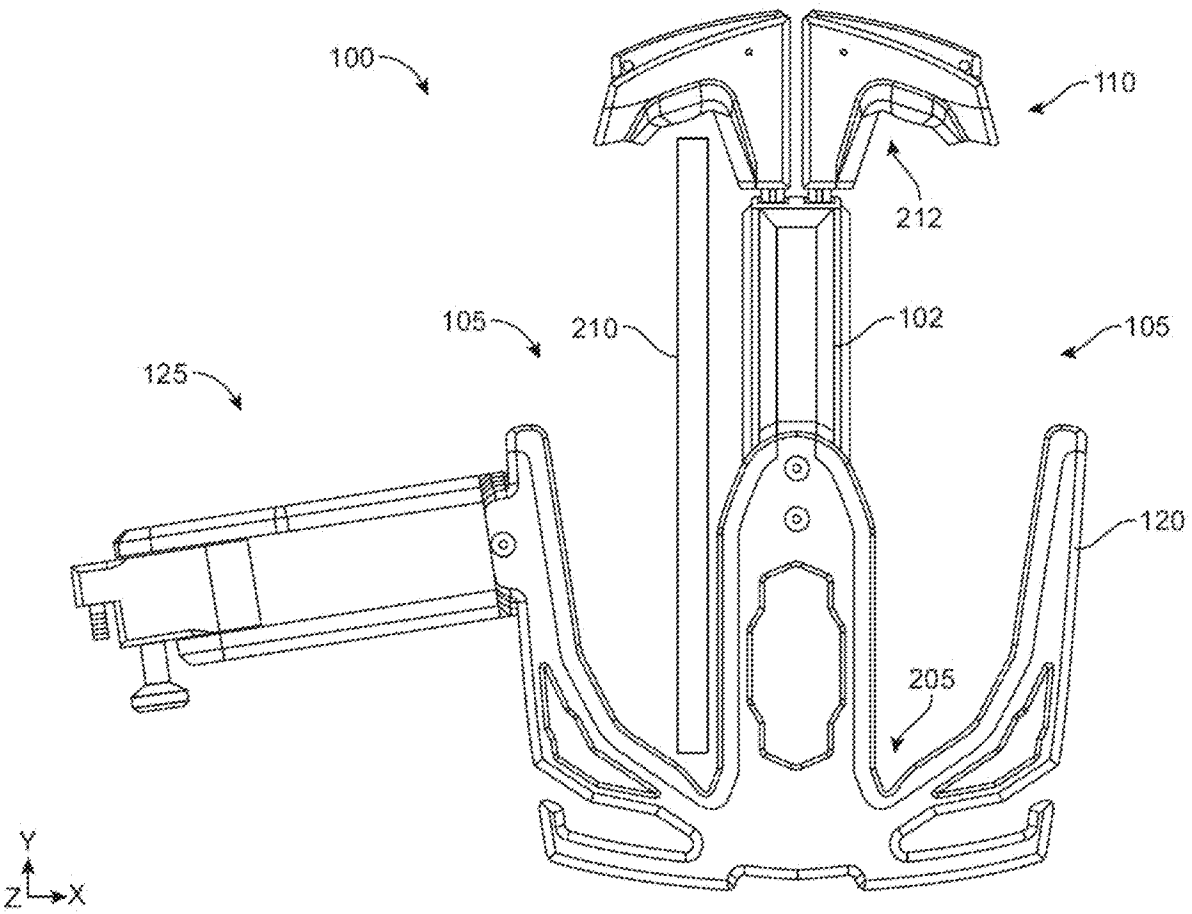
FIG. 2 shows a side view of the board storage device.
Figure 3:
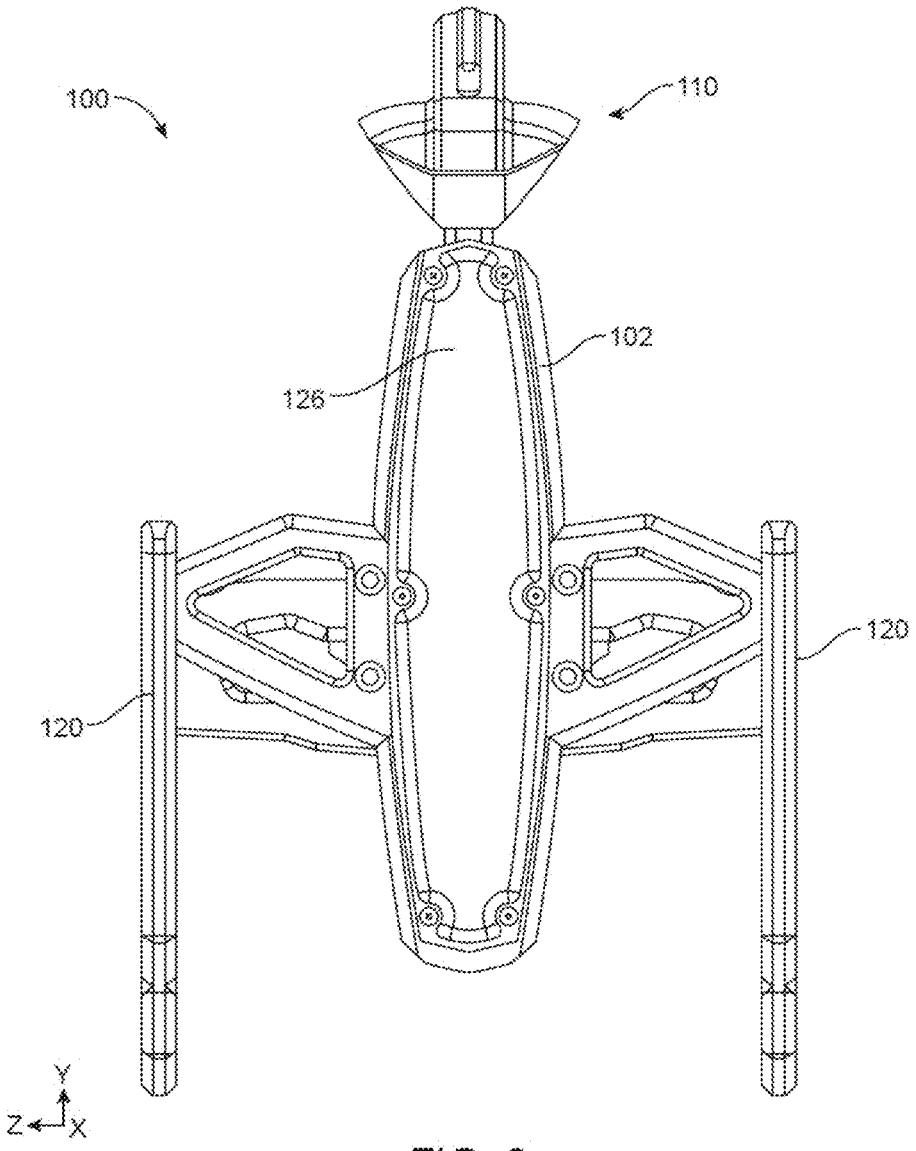
FIG. 3 shows a front view of the board storage device.

FIG. 1 shows a perspective views of an example board storage device 100 (also referred to as "storage device 100 or device 100".) FIG. 2 shows a side view of the board storage device 100. FIG. 3 shows a front view of the example board storage device 100.

The board storage device 100 may be mounted on a structure such as on a portion of a watercraft for storing one or more wakeboards on the watercraft. For example, the device may be mounted using clamps, bolts, or other attachment mechanism such as the attachment mechanism 125. The device may be mounted on any portion of the watercraft, such as on a sidewall of a ski boat or any boat that can be used for recreation.

The storage device 100 can be a body that includes a central structure, such as a pillar or post 102, from which one or more arms 120 extend to define rack assemblies 105 that are each configured to store one or more boards. In this regard, each rack assembly 105 (sometimes referred to as a "rack") defines one or more receivers, openings or seats wherein each seat is sized and shaped to receive at least one board therein. One or more bridge structures extend outwardly from the post 102 to connect to a second and third structure (such as post members positioned in parallel relationship with the post 102) from which the arms 120 extend. In another embodiment, the device 100 only includes a single rack assembly or more than two rack assemblies. In FIG. 2, a wakeboard 210 is schematically represented in position within one of the rack assemblies 105 of the board storage device 100. A wakeboard 210 can also be positioned in the other rack assembly 105. It should be appreciated that the wakeboard is a flat or curved planar member that extends outward from the plane of FIG. 2. It should be appreciated that a wakeboard 210 (or other type of board) can have a concave or curved outer surface. In other embodiments, the outer surfaces are flat.

With reference still to FIGS. 1 and 2, each of the two rack assemblies 105 is defined by the central post 102 and the arms 120 that extend outwardly from the post 102. In the embodiment of FIGS. 1-3, the arms 120 extend outwardly in opposite directions relative to the post 102. Each of the arms 120 forms a bottom seat 205 on which a bottom (with respect to FIG. 2) edge of the board 210 can sit or abut. Given that there are two arms 120 in the embodiment of FIG. 2, the bottom seats 205 form second and third seats 205 (with an upper seat 212 forming a first seat 212 as described below.) The shape of each arm 120 can vary and is not limited to the shape shown in the figures. In the illustrated embodiment, each arm 120 extends outwardly from a post member (such as a vertical post in the embodiment of FIGS. 1 and 2). The arm extends transversely outward to form a vertical section that extends upwardly from a base of the arm 120 attached to the post. In this manner, the arm 120 forms a seat 205 as described below. The seat is located at a juncture between the base of the arm 120 and the post from which it extends. The second and third seats can be at positions opposed to the first seat such that the first, second, and third seats collectively form a triangular shape when connected by a line.

For each rack assembly 105, an upper clamp member 110 forms the upper (or first) seat 212 that is sized, positioned, and shaped to contact a top edge of the board 210. The upper clamp member 110 is mounted on an upper end of a clamp arm 405 (FIG. 4) that is slidably and telescopically positioned within the central post 102. Thus, the clamp arm 405 and the attached upper clamp member 110 can slide relative to the post, such as along an axis defined by the post 102. For example, the axis can be co-axial with the post 102.

The clamp arm 405 can be a tubular or cylindrical structure for example. The upper seat 212 can be coated with or formed by a pliable, malleable or soft material. In an implementation, the upper clamp member 110 can be configured to rotate between first and second positions. The upper clamp members rotate about an axis (which can be the axis defined by the post 102) defined by the respective arm 405 to which it is attached. This permits the upper clamp members to rotate out of position thereby permitting easier insertion or removal of the boards from the assembly. The upper clamp arm 405 can be fixedly attached to the arm 405 such that it collectively rotates with the attached arm 405. Or, in an alternate embodiment, the upper clamp member rotates relative to the respective arm 405 about an axis defined by the arm 405.

The upper seat 212 (which isn't necessarily an "upper" seat in the horizontal embodiment described below") can be entirely or partially manufactured of a deformable material that is configured to deform when the board is clamped within the device. The deformation of the material creates or otherwise facilitates a force relative to the board that positions the board in tension or compression and thereby increase the likelihood that the board will remain in place when it is clamped by the upper clamp 405.

When the board is positioned within a respective rack assembly 105 of the board storage device, the board has three points of contact with the respective rack assembly of the board storage device including (1) a point of contact at the upper, or first, seat 212; and (2) a separate point of contact at each the two bottom, or second and third, seats 205 of the rack assembly (for a total of two points of contact at the bottom of the board). The three points of contact enable a tight fit between the board and the rack assembly, which is increased by the deformation of the material of the upper seats and bottom seats (which can also be at least partially manufactured of a deformable or resilient material) to place the board's in tension or compression during clamping.

Figure 15:
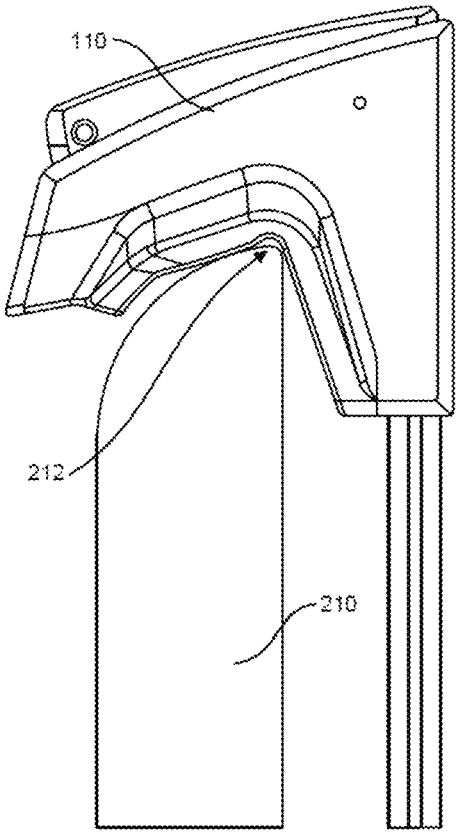
FIGS. 15 and 16 show side views of a wakeboard and an upper clamp member.
Figure 16:
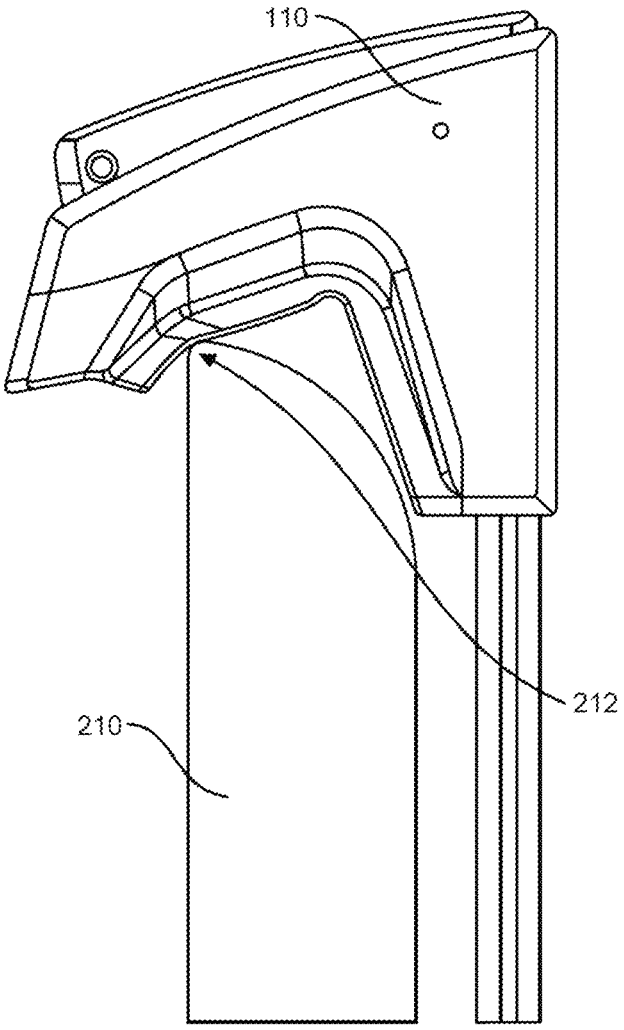

FIGS. 15 and 16 show side views of a wakeboard 210 having at least one outer, curved (such as concave or convex) surface positioned in engagement with the upper clamp member 110. The upper clamp member 110 can have a hook shape and thus may also be referred to as a retaining hook. The upper seat 212 can define one or more particular points of contact where the wakeboard 210 engages the upper seat 212. The upper seat 212 defines an outer surface that contacts the wakeboard 210 when it is mounted in the rack. The outer surface of the upper seat 212 can be smooth and continuous at least along a portion thereof and may also have one or more irregularities, notches, opens, holes, cavities, or other structures that are configured to facilitate engagement between the wakeboard and the upper seat. For example, the structure (such as the notch) can be particularly sized and shaped to receive an edge of the wakeboard, a concave or convex portion of the wakeboard, or any other defined portion of the wakeboard.

When the wakeboard 210 is inserted into the rack and positioned in engagement, such as direct contact, with the upper seat 212, the wakeboard 210 can be inserted with the curved outer surface of the wakeboard facing either of one of two directions, such as directions that are 180 degrees from each other. The concave or curved outer surface of the board 210 can facilitate, govern, or dictate where on the upper seat 212 the wakeboard 210 rests against. In this regard, the upper seat 212 can have one or more notches, cavities, reliefs, or other engagement structures (as described above) that are configured to facilitate engagement between a curved outer surface of the wakeboard 210 and the upper seat 212. The upper seat 212 can have any number of such engagement structures in which a curved outer surface or pointed surface of the board is configured to fit in a snug or complementary manner to facilitate restrained or fixed engagement between the board and the upper seat.

As mentioned, the clamp arm 405 (and the attached upper clamp member 110) can move (such as in a sliding fashion) between a first, unclamped position and a second, clamped position. In an example, the clamp arm, when in the second, clamped position (such as shown in FIGS. 1-3), the clamp arm 405 is retracted into the central post 102 such that the upper clamp member 110 is closer to the bottom seat 205 (relative to the first position.) In this manner, the upper clamp member 110 can place the wakeboard in compression (between the upper clamp member 110 and bottom seat 205) to retain the wakeboard in place. The central post 102 includes an internal lock mechanism that automatically keeps and locks the clamp arm (and attached upper clamp member 110) in the first position when the upper clamp member 110 is moved toward the bottom seat 205 by a user. An exemplary and non-limiting internal lock mechanism is described in more detail below with reference to FIGS. 7-12.

Figure 4:
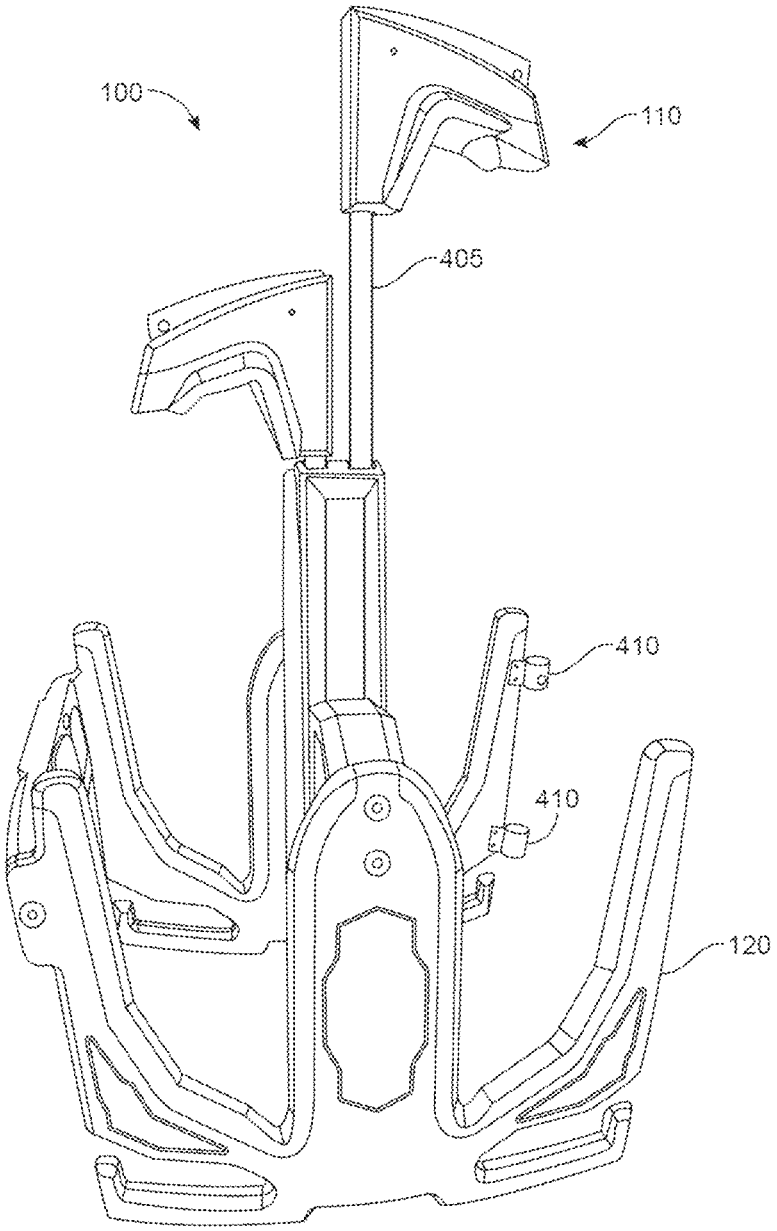
FIG. 4 shows a perspective view of the board storage device with a clamp arm in an open or extended position.

The clamp arm 405 can be released from the second, clamped position by actuating an actuator, such as a levered actuator 505, as described below. When actuated, the actuator releases the clamp arm from the second, clamped position such that a user can slidably extend the clamp arm outwardly (e.g., upwardly in the embodiment if FIG. 3 and horizontally in the embodiment of FIG. 13) from the central post 102. In this manner, the upper clamp member 110 slides away from the bottom seat 205 so as to provide sufficient space so that the wakeboard can be removed from the board storage device 100. As mentioned, in an example embodiment the upper clamp member can rotate to provide additional space for the board to be inserted into the board storage device. FIG. 4 shows the board storage device 100 with the clamp arm 405 in the second, unclamped state.

It should be appreciated that each rack assembly can have any quantity of arms 120 to form a desired quantity of seats. A wakeboard 210 (or other board) may be sized with a length so that the board extends between the two seats 210 of each rack assembly.

Each seat 205 includes a base surface (the upper surface of each seat 205) that forms a surface upon which a board can be positioned or rested upon. When positioned in the seat 205, a bottom edge of the board rests on the seat 205. The seat 205 can be formed of or coated with a material that is soft or is otherwise configured to present a soft or malleable surface for the board.

Figure 5:
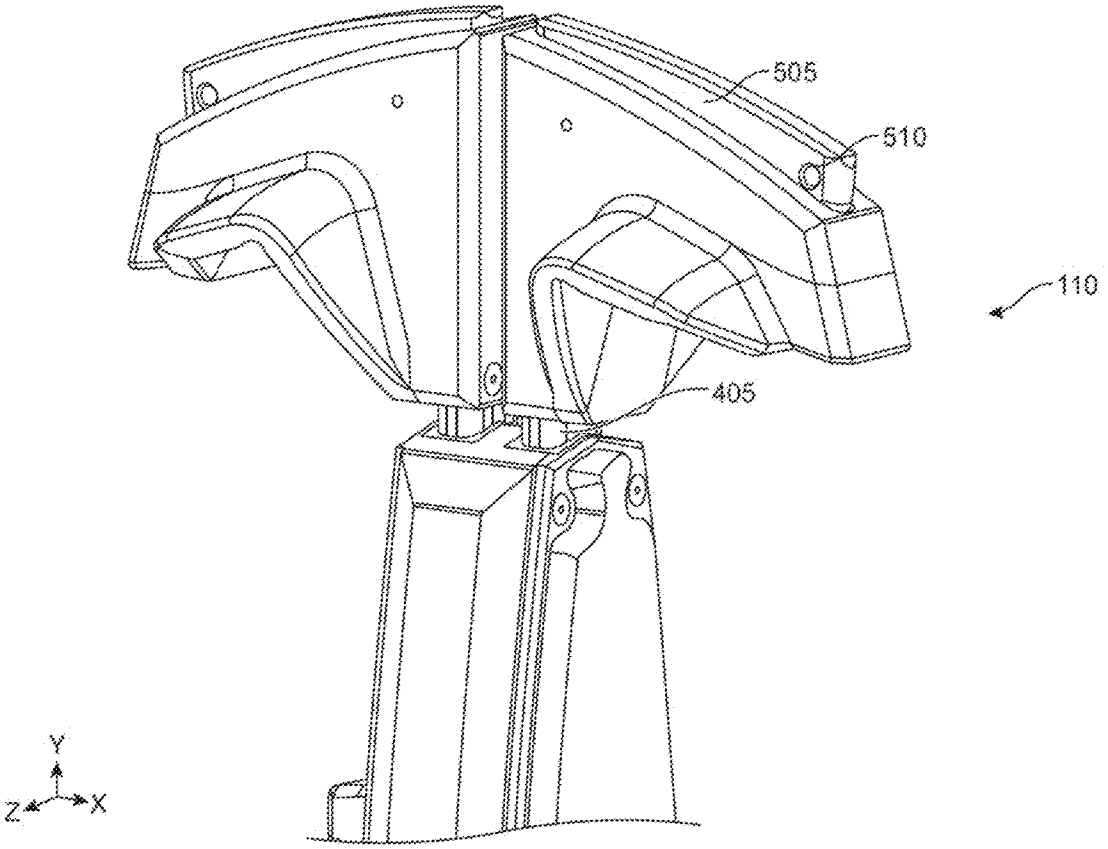
FIG. 5 shows an enlarged view of an upper clamp member of the board storage device.

FIG. 5 shows an enlarged view of the upper clamp member 110, which is mounted on the clamp arm 405. An actuator 505, such as a levered member 505, is movably coupled to the upper clamp member 110 as well as to an internal lock mechanism. The member 505 can be actuated, such as by pushing the member 505 toward the upper surface of the clamp member 110. This causes the member 505 to rotate or pivot about an axis and actuate an internal mechanism that releases the arm from the second, clamped state and permits the upper clamp member 110 to be moved toward the first, unclamped state. In this manner, a user can actuate the member 505 to raise the upper clamp member and release the boards from the rack assembly.

With reference still to FIG. 5, the system includes a securing mechanism configured to secure the actuator from being actuated. For example, an opening or bore 510 is positioned in the member 505. A lock, such as a padlock (or other device such as a pin), can be inserted through the bore 510 to prevent the member 505 from being actuated and thereby lock the upper clamp member 110 in the second, clamped state. That is, the law prevents the actuator from being actuated and thereby prevents the clamp member for moving from the second position to the first position.

With reference now to FIG. 6, a hook 605 is located on the storage device 100 such as on a bottom region of the storage device 100. The hook 605 is sized and shaped to serve as a hook from which items, such as life preservers or articles of clothing, can be hung.

With reference again to FIG. 4, the device includes flag couplers 410, such as cylindrical members 410 each with cylindrical openings, through which a flag can be mounted. Each cylindrical member 410 defines an internal lumen through which the post on which a flag is mounted can be inserted.

Figure 7:
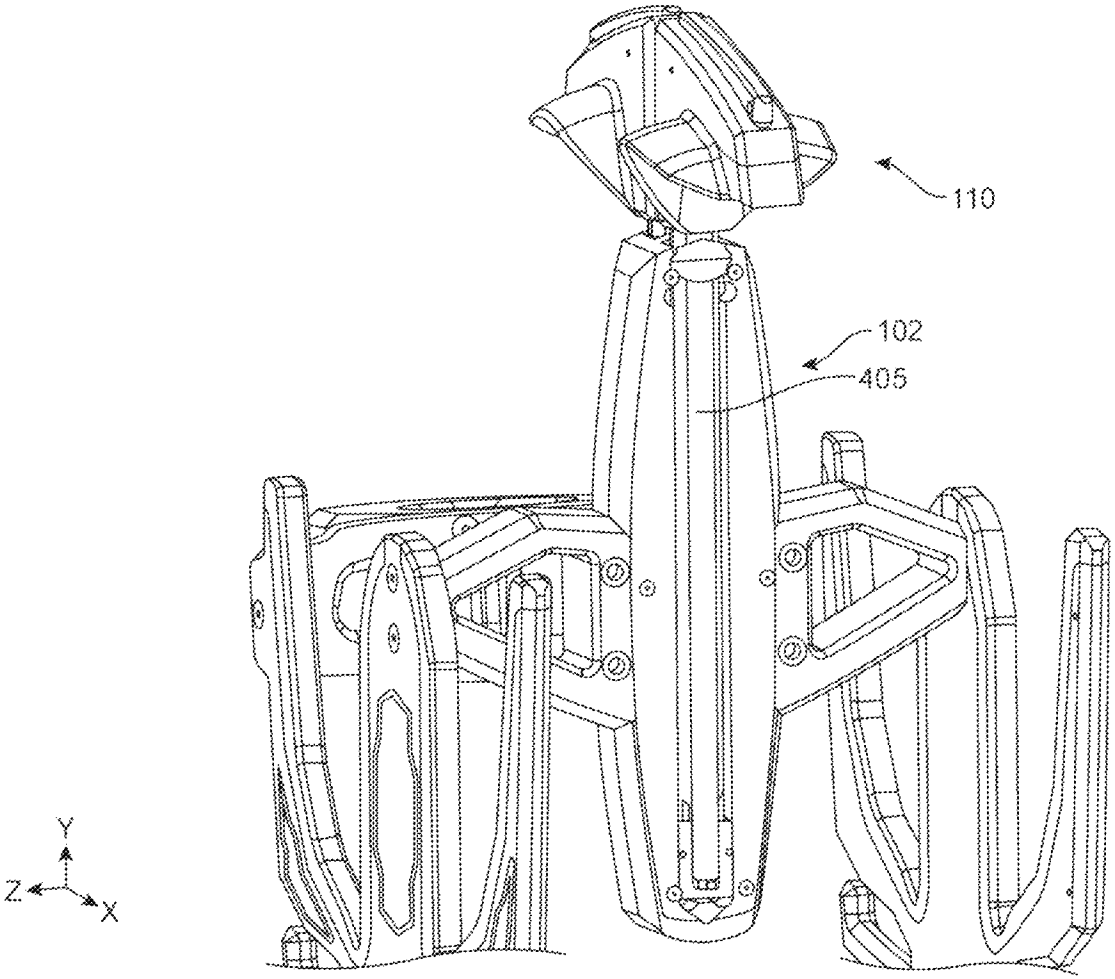
FIGS. 7-12 show various views of an internal lock mechanism of the board storage device.
Figure 8:
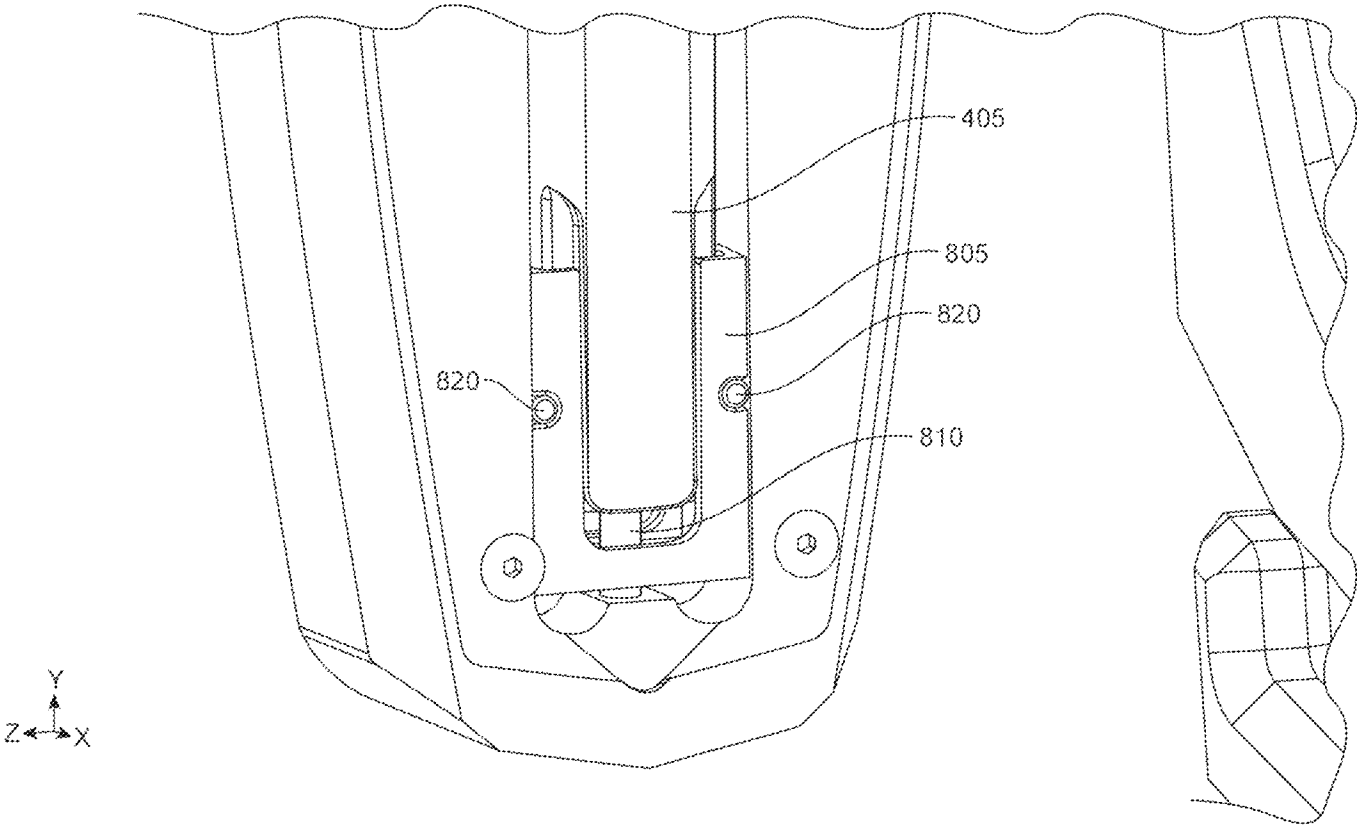

As mentioned, the central post 102 includes an internal lock mechanism. An example lock mechanism is now described in more detail. With reference again to FIG. 3, the central post includes a cover 126 that covers an internal region where the lock mechanism resides. FIG. 7 shows the central post 102 with the cover 126 removed such that the clamp arm 405 is visible. The clamp arm extends from the upper clamp member 110 to a bottom region, which is shown in an enlarged view in FIG. 8. A foot 805 is located at the bottom of the clamp arm 405, as shown in FIG. 8. An elongated rod 810 extends longitudinally through the clamp arm 405 and is attached at a bottom end to the foot 805. The foot defines a pair of openings in which are seated a corresponding pair of pins 820.

Figure 9:
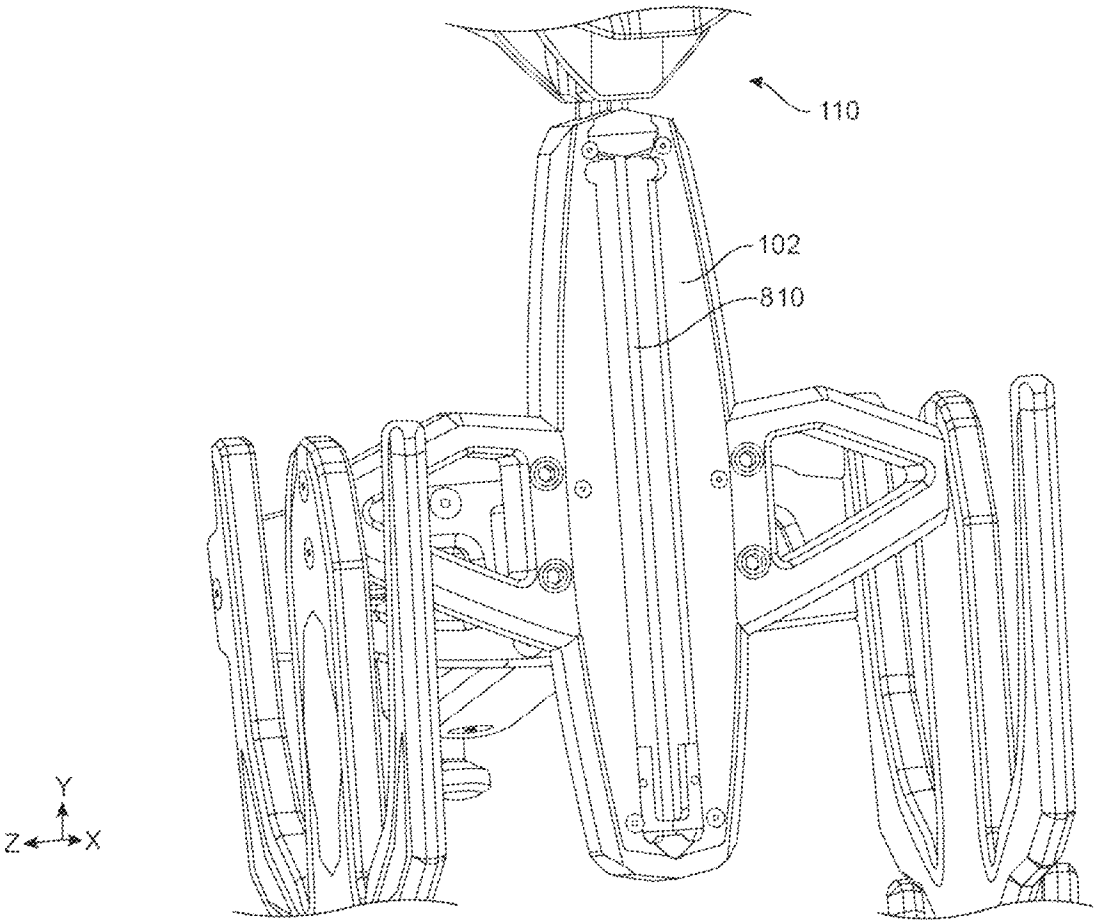
Figure 10:
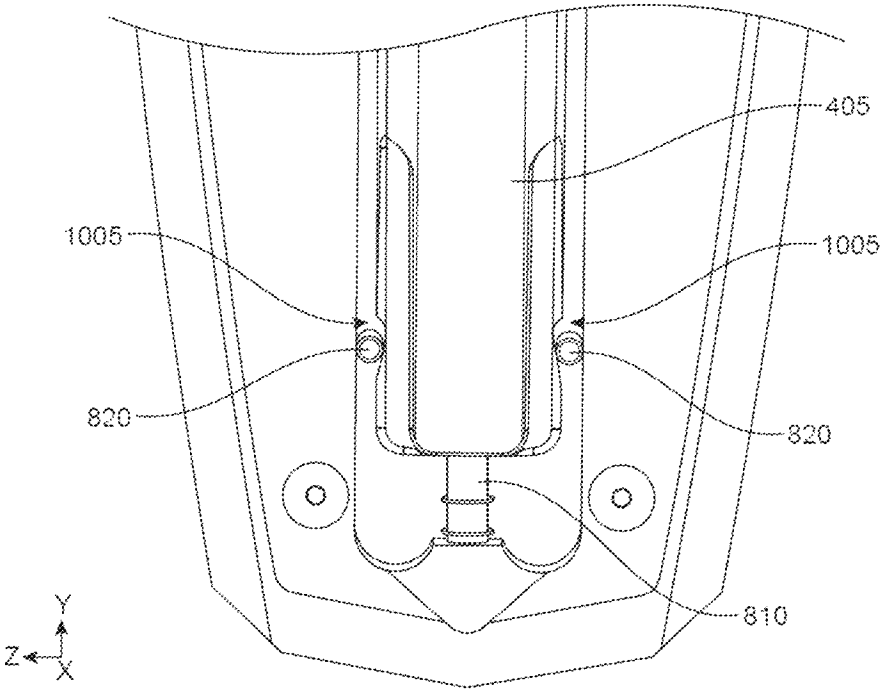

FIG. 9 shows the central post 102 with the clamp arm 405 removed such that the elongated rod 810 is visible. The rod is attached at its top end to the actuator 505, as described further below, and is slidably positioned within the central post 102. FIG. 10 shows the bottom region of FIG. 8 with the foot 805 removed and the pins 820 still in place. A bottom region of the clamp arm 405 has a pair side edges that each define ramped surfaces that form clearance areas 1005 that are wider in diameter than the pins 820. The ramped surfaces gradually increase the width of the clamp arm 405 such that the pins 820 can become locked between the ramped surfaces and an outer wall in which the clamp arm is positioned. When locked as such, the pins 820 retain the clamp arm 405 in place relative to the central post 102.

Figure 11:
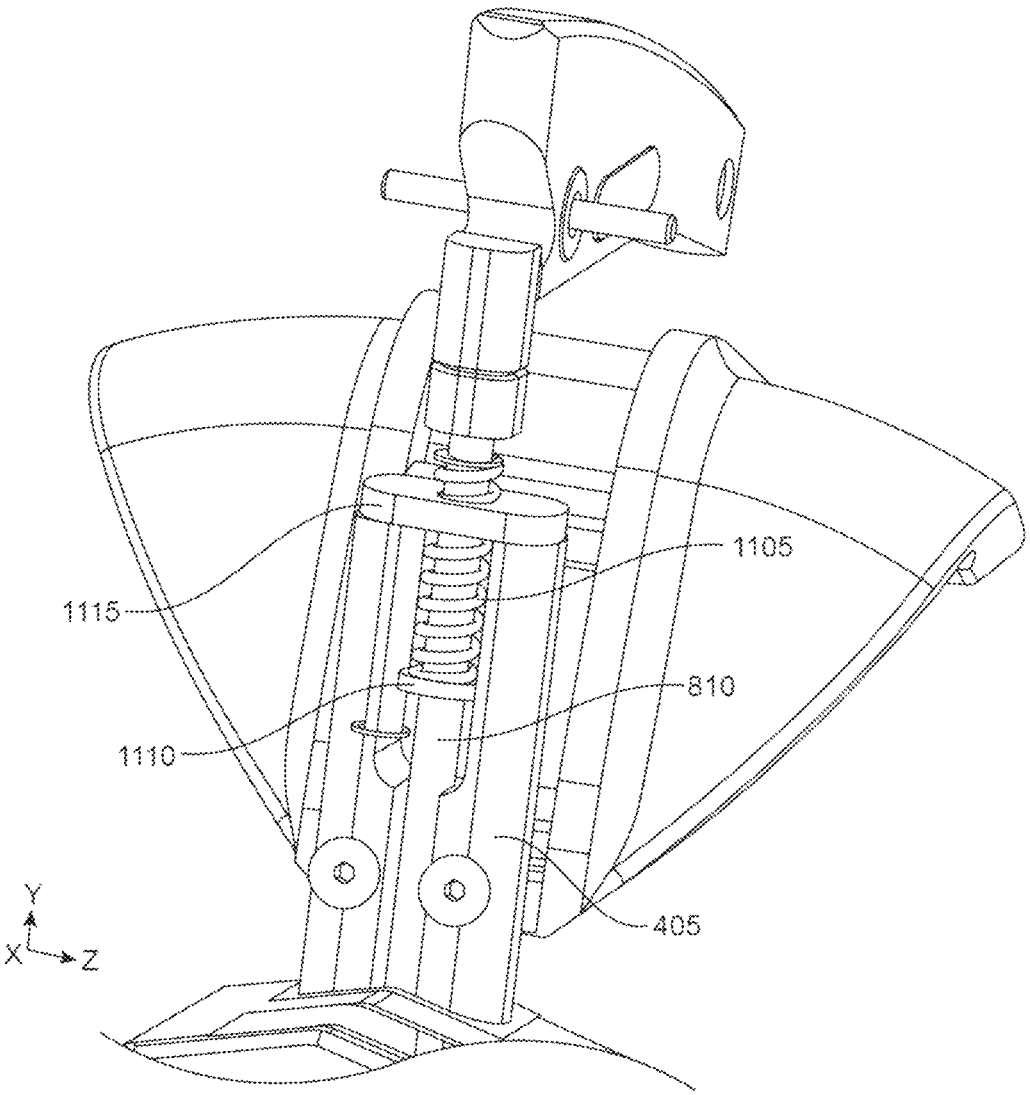

FIG. 11 shows an upper region of the clamp arm 405 with an outer cover of the upper clamp member 110 removed to show a rod assembly that includes the rod 810. A bias member, such as a spring 1105, is co-axially positioned over the rod 810 between a lower washer 1110 and an upper washer 1115 such that the spring 1105 is compressed therebetween. The lower washer 1110 is attached to the rod 810 such that it moves with the rod 810. The upper washer is fixed or stationary such that it does not move with the rod 810. The spring 1105 provides a spring force that biases the rod assembly downward.

With reference again to FIG. 10, the locking ramped surfaces allow for locking or releasing the pins 820. When at rest, the spring force of the spring 1105 pushes the rod 810 and the attached foot 805 (FIG. 8) downward, which moves the locking pins 820 against the ramped surfaces to create a locking pressure against the locking pins 820 and thereby retain the clamp arm 405 in place within the central post 102.

Figure 12:
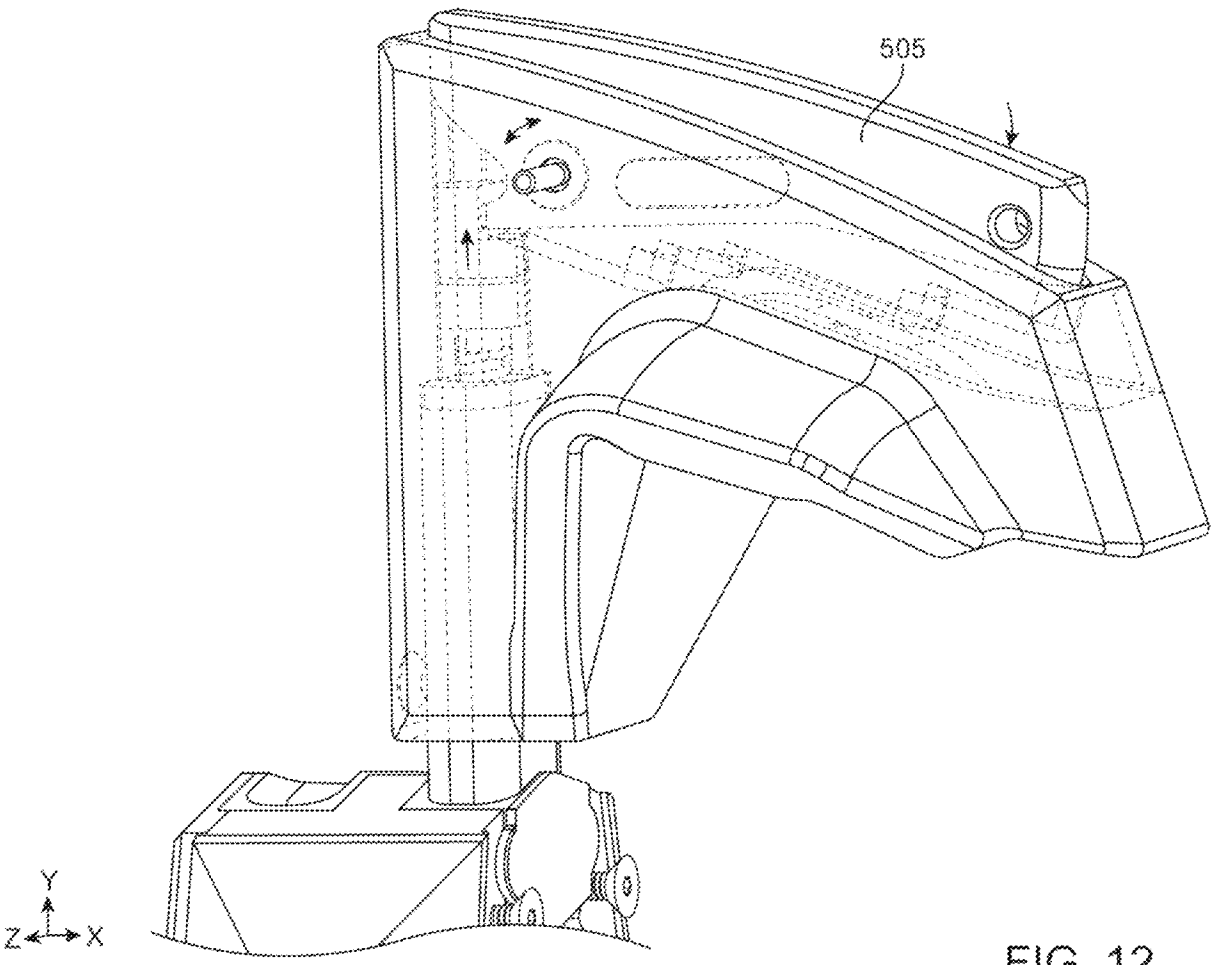

When the upper actuator 505 is pressed as shown in FIG. 12, the rod and the foot 805 move upward, which moves the locking pins 820 to the clearance area 1005 (FIG. 10) and thereby releases the locking pins from the locked state to permit the clamp arm 405 to move upward and release the clamped boards.

FIG. 12 shows the upper region of the clamp arm 405 with an outer cover of the upper clamp member 110 in transparent state to show another view of the rod assembly. In use, a user presses down on the actuator 505, which is in the form of a lever.

As mentioned, the device 100 can be attached to a boat or other vehicle. In an embodiment, the device 100 is removably attached to the boat or the vehicle such as using a clamp or other removable attachment device.

Figure 13:
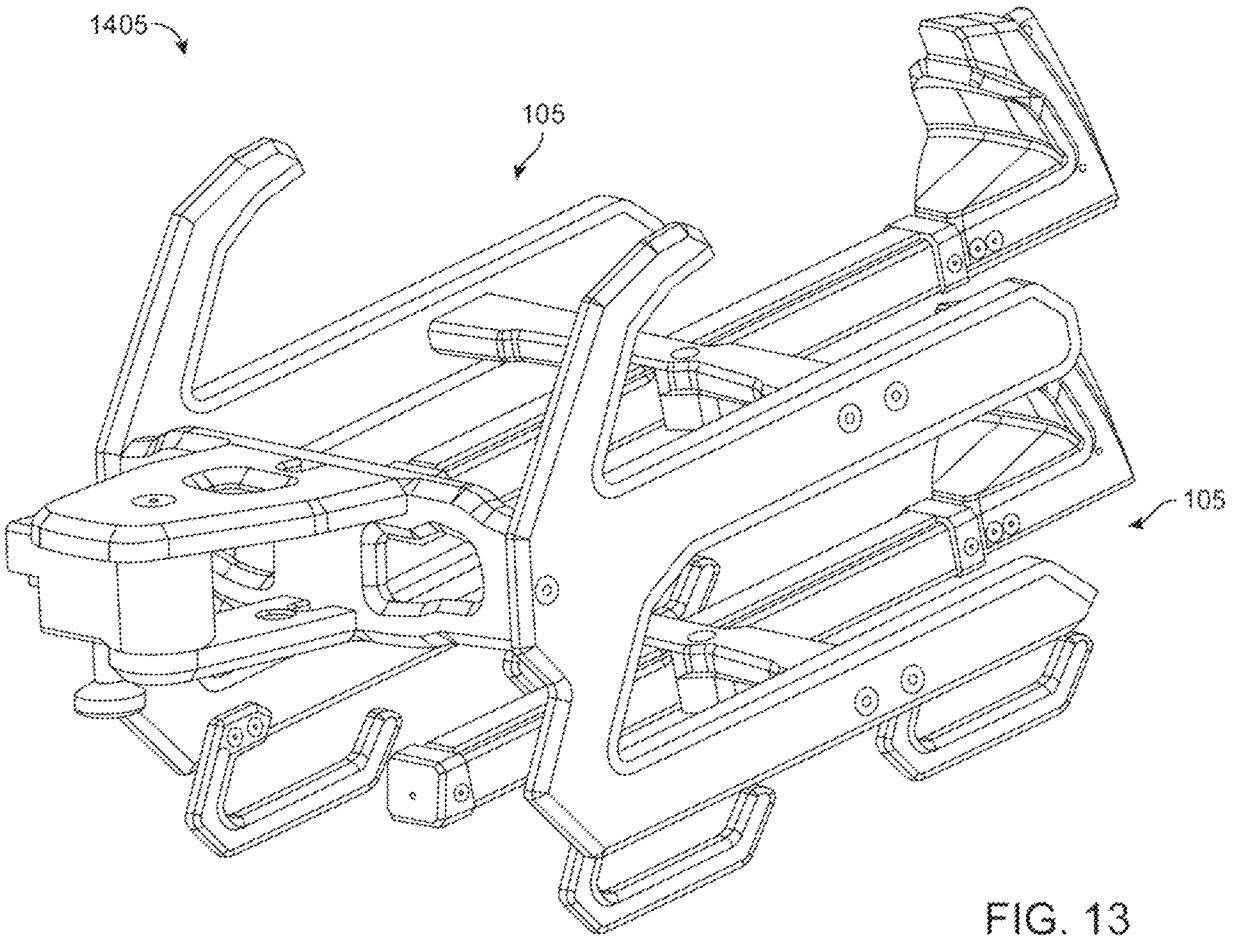
FIG. 13 shows another embodiment of a board storage device.

FIG. 13 shows another embodiment of a board storage device 1405. The board storage device 1405 includes a pair of rack assemblies 105. In this embodiment, the board storage device 1405 is configured to support the boards in a horizontal orientation rather than in a vertical orientation as in the previous embodiment. The board storage device 1405 supports the flat surfaces of the boards such that the boards are facing in a common direction. This is in contrast with the previous embodiment where the board storage device supports the flat surfaces of the boards in opposite directions. In this regard, each rack assembly 105 of the board storage device 1405 includes a base member that supports a bottom surface of the board.

Figure 14:
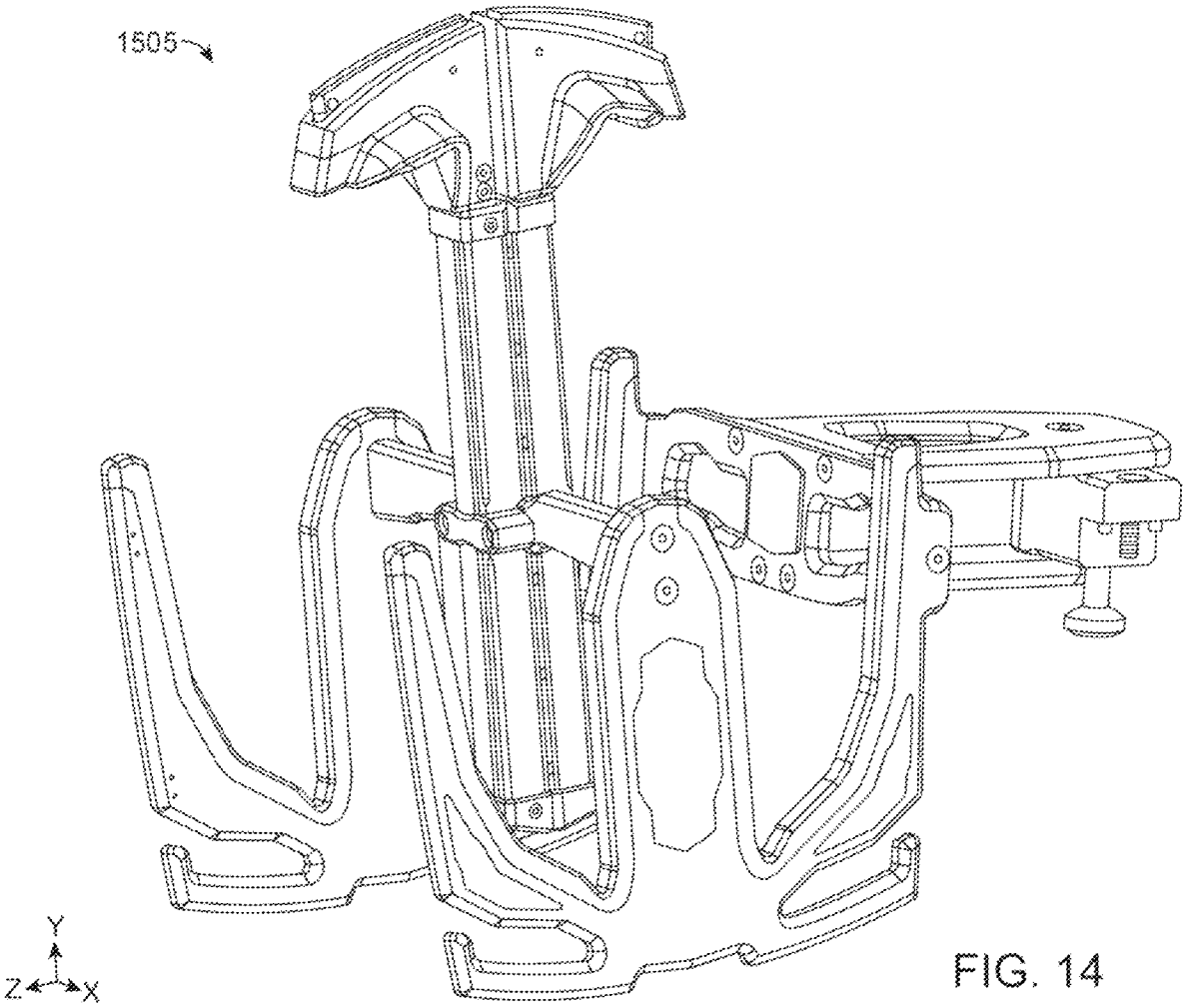
FIG. 14 shows yet another embodiment of the board storage device.

FIG. 14 shows yet another embodiment of the board storage device 1505 that supports the boards in a vertical orientation as in the first embodiment. In this embodiment, the centerpiece of the board storage device 1505 can be manufactured by an extrusion process or as a unibody construction.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

The invention claimed is:

1. A wakeboard storage apparatus, comprising:

a body defining a post;

a clamp member mechanically coupled to the post, the clamp member slideably movable relative to the post along an axis defined by the post, the clamp member being slideably movable between an clamped position and a unclamped position, the clamp member defining a first seat that engages a first portion of the wakeboard when the wakeboard is stored in the wakeboard storage apparatus, wherein the first seat includes at least one notch sized and shaped to receive an edge of the wakeboard when the wakeboard is stored in the wakeboard storage apparatus and wherein the first seat is formed of a deformable material, and wherein the clamp member can rotate about the axis;

a pair of arms connected to the post, the pair of arms defining second and third seats that further engage second and third portions of the wakeboard when the wakeboard is stored in the wakeboard storage apparatus, wherein, when in the clamped position, the clamp member compresses the wakeboard between the first, second, and third seats to retain the wakeboard between the first, second and third seats when the wakeboard is stored in the wakeboard storage apparatus;

an actuator mechanism that can be actuated to move the clamp member between the clamped state and the unclamped state; and a lock mechanism that locks the clamp member in the clamped or unclamped position.

2. The wakeboard storage apparatus of claim 1, wherein the first seat is an upper seat and the second and third seats are lower seats.

3. The wakeboard storage apparatus of claim 1, wherein the clamp member defines a hook shape.

4. The wakeboard storage apparatus of claim 1, further comprising a hook on the body that can support a device.

5. The wakeboard storage apparatus of claim 1, further comprising a flag holder on the body.

6. The wakeboard storage apparatus of claim 1, further comprising a securement mechanism that prevents the actuator from being actuated.

7. The wakeboard storage apparatus of claim 1, wherein clamp member moves at least partially toward the second and third seats as the clamp member moves from the unclamped position to the clamped position.

8. The wakeboard storage apparatus of claim 1, wherein the actuator is a rotatable lever.

9. The wakeboard storage apparatus of claim 1, further comprising the wakeboard.

10. The wakeboard storage apparatus of claim 1, wherein the body is coupled to an attachment mechanism configured to attach the body to a boat.

* * * * *